US007513735B2

(12) United States Patent
Sarri

(10) Patent No.: US 7,513,735 B2
(45) Date of Patent: Apr. 7, 2009

(54) MULTISTAGE CENTRIFUGAL COMPRESSOR HAVING A TANK WHICH CAN BE OPENED HORIZONTALLY

(75) Inventor: Franco Sarri, Florence (IT)

(73) Assignee: Nuovo Pignone Holding S.p.A., Florence (IT)

( * ) Notice: Subject to any disclaimer, the term of this patent is extended or adjusted under 35 U.S.C. 154(b) by 384 days.

(21) Appl. No.: 10/595,711

(22) PCT Filed: Nov. 1, 2004

(86) PCT No.: PCT/EP2004/012488

§ 371 (c)(1),
(2), (4) Date: May 5, 2006

(87) PCT Pub. No.: WO2005/045251

PCT Pub. Date: May 19, 2005

(65) Prior Publication Data

US 2007/0110569 A1 May 17, 2007

(30) Foreign Application Priority Data

Nov. 7, 2003 (IT) ..... MI2003A2149

(51) Int. Cl.
*F01D 1/02* (2006.01)

(52) U.S. Cl. ..... 415/100; 415/198.1; 415/199.1; 415/199.2; 415/213.1; 415/214.1

(58) Field of Classification Search ..... 415/100, 415/198.1, 199.1, 199.2, 213.1, 214.1
See application file for complete search history.

(56) References Cited

U.S. PATENT DOCUMENTS

| | | | | |
|---|---|---|---|---|
| 2,578,617 | A * | 12/1951 | Watson | 415/199.3 |
| 3,229,642 | A * | 1/1966 | Lobanoff et al. | 415/100 |
| 3,788,764 | A * | 1/1974 | Shuey et al. | 415/199.3 |
| 3,801,217 | A * | 4/1974 | Ryall et al. | 415/199.2 |
| 3,861,825 | A * | 1/1975 | Blom | 415/199.3 |
| 4,778,334 | A * | 10/1988 | Medgyesy et al. | 415/199.1 |
| 6,884,031 | B2 * | 4/2005 | Gregory | 415/199.2 |

FOREIGN PATENT DOCUMENTS

| | | | |
|---|---|---|---|
| DE | 3635341 | A1 | 4/1990 |
| FR | 1306368 | A | 10/1962 |
| FR | 2572469 | A1 | 5/1986 |
| GB | 2181785 | A | 4/1987 |

* cited by examiner

*Primary Examiner*—Igor Kershteyn
(74) *Attorney, Agent, or Firm*—GE Global Patent Operation

(57) ABSTRACT

Multistage centrifugal compressor having a horizontally openable tank, comprising a lower semi-tank and an upper semi-tank, a shaft having a series of rotors and a series of stages each of which comprising, in turn, a series of lower semi-diaphragms and a series of upper semi-diaphragms, a lower half-ring and an upper half-ring which can be coupled to form a bearing ring, the lower half-ring being fastened internally to the lower semi-tank , and the corresponding upper half-ring being fastened to the upper semi-tank , in each stage of the multistage centrifugal compressor, the lower semi-diaphragms are rigidly constrained to one another to form a first pile of lower semi-diaphragms and, the corresponding upper semi-diaphragms are rigidly constrained to one another to form a second pile of lower semi-diaphragms, the first pile can be constrained to the lower half-ring and the second pile can be constrained to the upper half-ring.

6 Claims, 3 Drawing Sheets

MULTISTAGE CENTRIFUGAL COMPRESSOR HAVING A TANK WHICH CAN BE OPENED HORIZONTALLY

Figure 1:
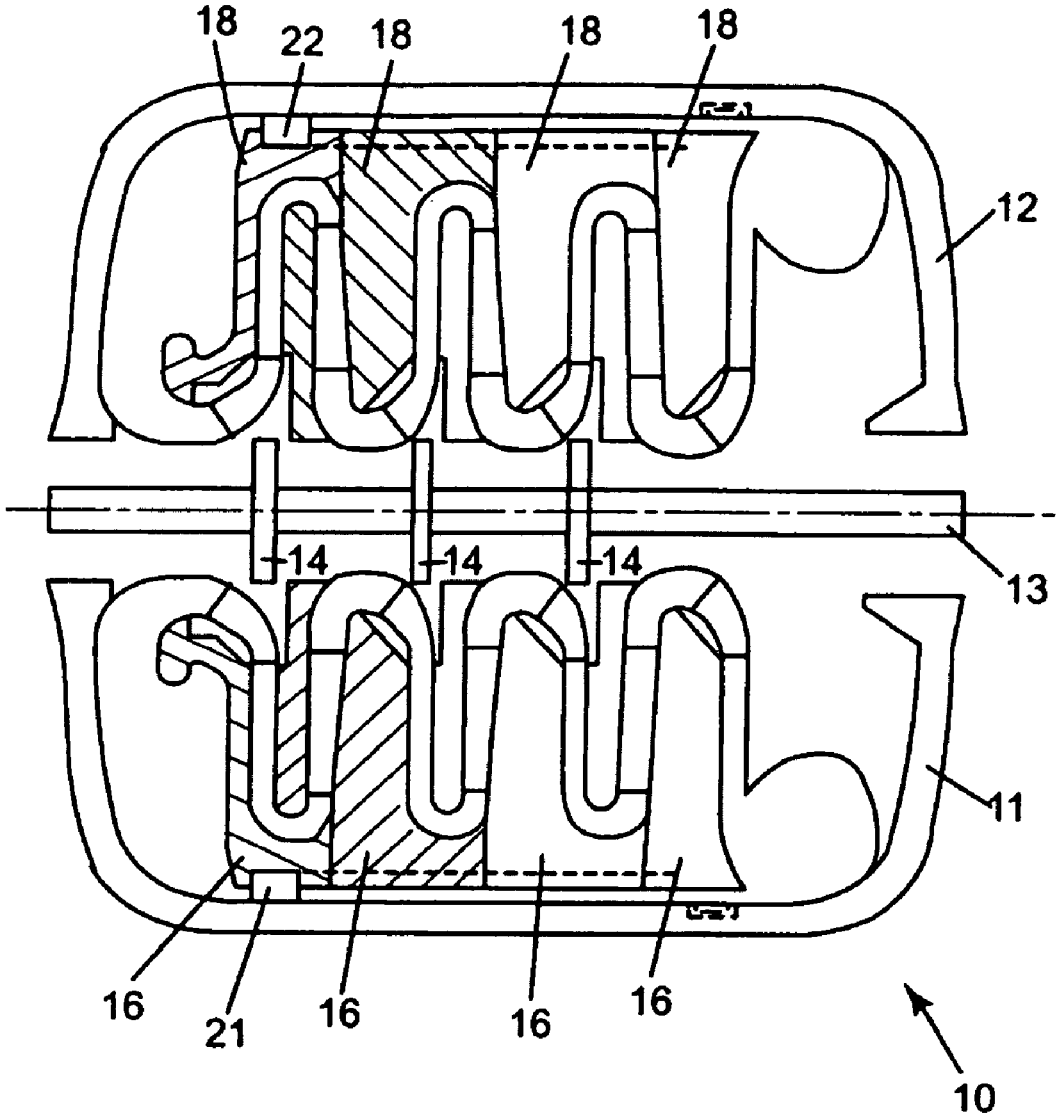
Figure 2C:
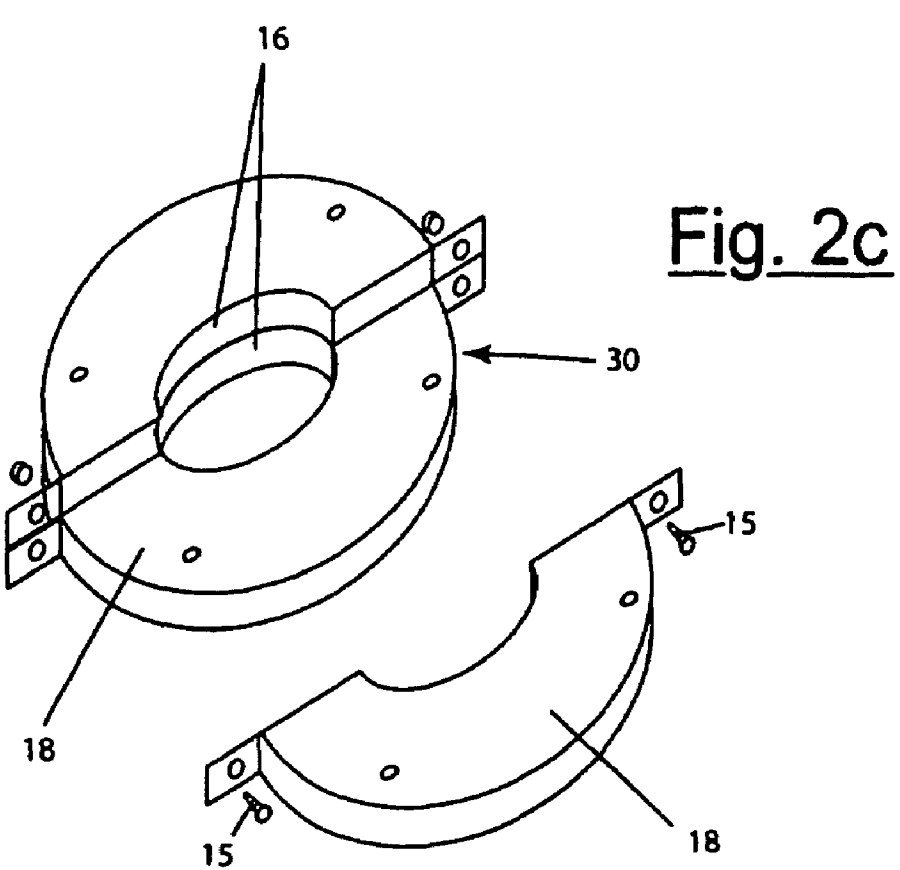
Figure 2A:
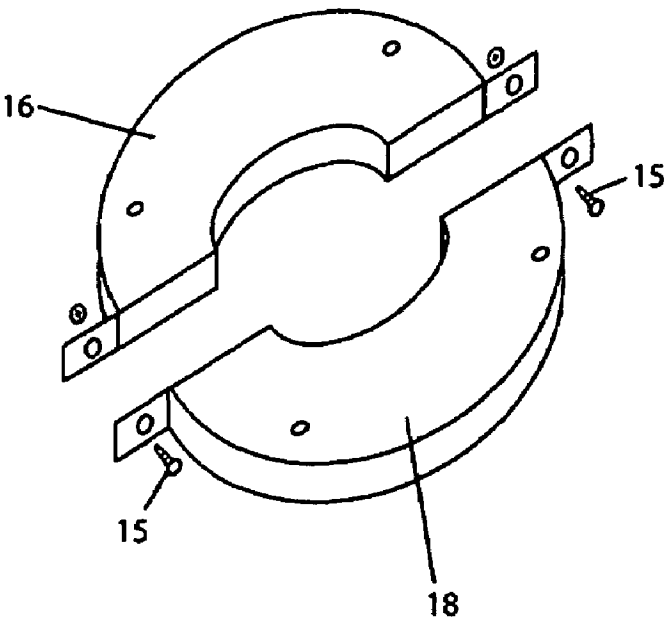
Figure 2D:
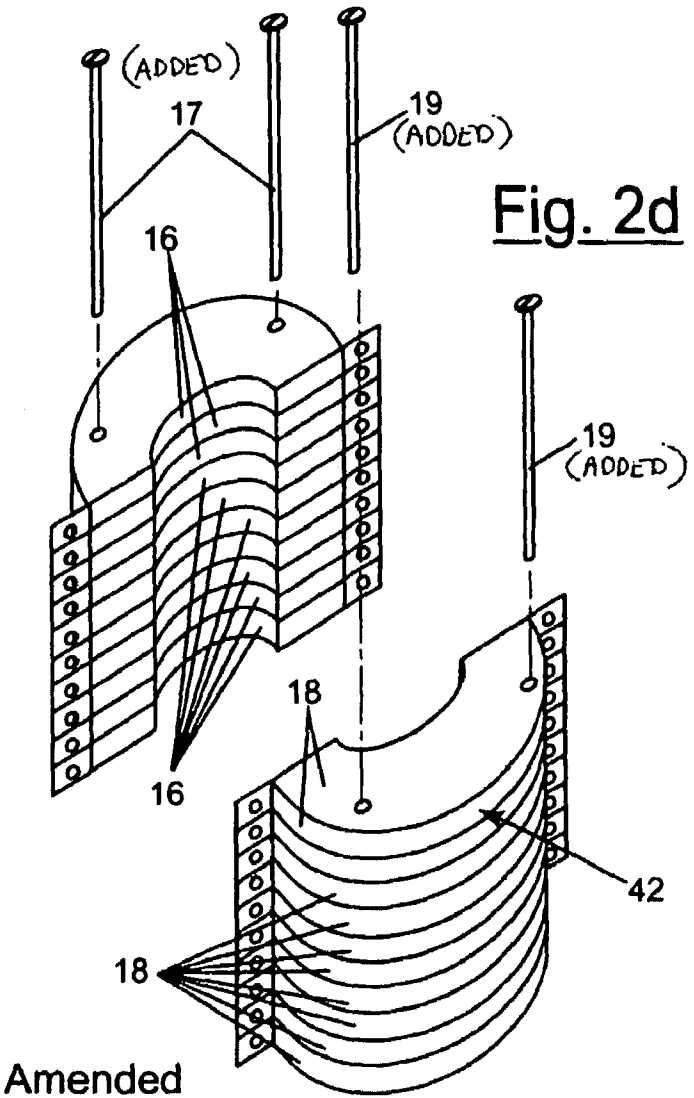
Figure 2B:
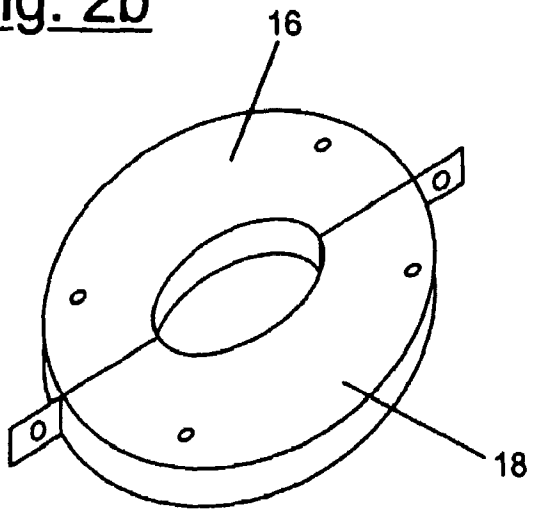

The present invention relates to a multistage centrifugal compressor having a tank which can be opened horizontally.

The fundamental elements forming a multistage centrifugal compressor are a shaft equipped with a series of rotors or wheels, rotating round the machine axis, and a series of diffusors or diaphragms with return channels between the various stages, integral with a tank which contains said compressor.

Each rotor consists of a series of bladed disks assembled on the same shaft.

A diffusor follows each rotor disk.

Each diffusor is associated with a return channel, which conveys the fluid to the subsequent rotor.

The whole set of each rotor together with the relative diffusers and return channels forms a stage, which is separated from the adjacent ones by annular diaphragms and labyrinth-seal systems to avoid recycling between one stage and the other.

The centrifugal compressors are equipped with diaphragms consisting of two semi-diaphragms.

During the functioning of the multistage centrifugal compressor, the diaphragms are subjected to an axial force caused by the pressure differences due to compression of the fluid.

In order to counterbalance this force, it is therefore necessary to fix said semi-diaphragms to the stator of the multistage centrifugal compressor.

A bearing ring is envisaged for each single diaphragm, which is divided into an upper half-ring and a lower half-ring.

Each lower half-ring is welded to the lower tank, and the corresponding upper half-ring is welded to the upper tank.

Each upper semi-diaphragm is fixed to the corresponding upper half-ring, whereas each lower semi-diaphragm is fixed to the corresponding lower half-ring.

This is because the semi-diaphragms undergo axial stress during the functioning of the compressor and, without the supporting rings, they would tend to move, causing, among other things, sealing problems among the various stages.

The assembly of the semi-diaphragms in the tanks is extremely difficult, as it is necessary to center all the semi-diaphragms with the respective half-rings and also to center the lower semi-diaphragms with the corresponding upper semi-diaphragms.

At the same time, it is extremely important to keep the seal between the various stages of the centrifugal compressor.

For this reason, the semi-diaphragms are always fixed in advance to the corresponding half-rings.

In the assembly of a multistage centrifugal compressor, all the lower semi-diaphragms are first inserted into the lower tank, followed by the shaft with the rotors.

Similarly, the upper semi-diaphragms are inserted and fixed to the upper tank.

The upper tank can be assembled on the lower tank after being lifted by means of a bridge-crane, overturned and correctly placed on the lower semi-tank, in order to center all the semi-diaphragms.

High capacity/pressure multistage centrifugal compressors can be extremely heavy, up to 350 tons, and consequently the upper tank, with the upper semi-diaphragms fixed, can weigh even 150-200 tons.

One of the disadvantages is that costly lifting systems are necessary, capable of lifting the total weight of the upper tank on which the upper half-rings have been welded and the upper semi-diaphragms respectively fixed to the upper half-rings.

Another disadvantage is that it is not possible to effect controls on the positioning of the components inside the tank.

Furthermore, for maintenance, which is quite a common operation, such as the substitution of the labyrinth seal system, the overturning of the upper tank is required.

A further disadvantage is that in the case of particularly large and heavy machines, the overturning of the upper tank requires costly and complex equipment.

The objective of the present invention is to provide a multistage centrifugal compressor having a tank which can be opened horizontally, which is simple and with reduced costs and production times.

A further objective is to provide a multistage centrifugal compressor having a tank which can be opened horizontally, having reduced costs and assembly times.

Another objective is to provide a multistage centrifugal compressor having a tank which can be opened horizontally, which allows a higher safety level during maintenance operations.

Yet another objective is to provide a multistage centrifugal compressor having a tank that can be opened horizontally, which allows the dimension of the bridgecrane, necessary for assembling the multistage centrifugal compressor, to be reduced.

A further objective is to provide a multistage centrifugal compressor having a tank that can be opened horizontally, which allows reduced maintenance costs and times.

These objectives, according to the present invention, can be achieved by producing a multistage centrifugal compressor having a tank which can be opened horizontally, comprising a lower semi-tank 11, an upper semitank 12, a shaft 13 equipped with a series of rotors 14 and a series of stages 10, each of which, in turn, includes a series of lower semi-diaphragms 16 and a series of upper semi-diaphragms 18, a lower half-ring 21 and an upper half-ring 22, which can be coupled to form a supporting ring, said lower half-ring 21 being fixed inside the lower semi-tank 11 and the corresponding upper half-ring 22 being fixed inside the upper semi-tank 12, characterized in that in each stage 10 of the multistage centrifugal compressor, the lower semi-diaphragms 16 are rigidly constrained to one another by blocking means, to form a first pile 41 of lower semi-diaphragms 16 and the corresponding upper semi-diaphragms 18 are rigidly constrained to one another by blocking means, to form a second pile 42 of lower semi-diaphragms 16, and in that said first pile 41 can be constrained to said lower half-ring 21 and said second pile 42 can be constrained to said upper half-ring 22.

Further characteristics of the invention are illustrated in the following claims.

The characteristics and advantages of a multistage centrifugal compressor having a tank which can be opened horizontally according to the present invention, will appear more evident from the following illustrative and non-limiting description, referring to the enclosed schematic drawings, in which:

FIG. 1 is a raised, partially sectional view of the right side, according to a preferred embodiment of the present invention;

FIGS. 2*a*, 2*b*, 2*c* and 2*d* are exemplified perspective schematic views of a preferred assembly of a centrifugal compressor stage, according to the present invention.

With reference to the figures, these show a stage of a multistage centrifugal compressor having a tank which can be opened horizontally, comprising a lower semi-tank 11 and an upper semi-tank 12, a shaft 13 having a series of rotors 14 and a series of stages 10 each of which comprising, in turn, a series of lower semi-diaphragms 16 and a series of upper semi-diaphragms 18.

The multistage centrifugal compressor also includes, for each stage 10, a lower half-ring 21 and an upper half-ring 22, which can be coupled to form a supporting ring.

Said lower half-ring 21 is fixed inside the lower semi-tank 11 and said corresponding upper half-ring 22 is fixed inside the upper semi-tank 12.

In each stage of the centrifugal multistage compressor, only one lower half-ring 21 and one upper half-ring 22 are present in order to hold the corresponding lower semi-diaphragms 16 and the corresponding upper semi-diaphragms 18, respectively.

Said lower half-ring 21 constrains a lower semi-diaphragm 16 to the lower tank 11, so that said lower semi-diaphragm can bear the axial stress during the functioning of the centrifugal multistage compressor.

Analogously, said upper half-ring 22 constrains an upper semi-diaphragm 18 to the upper tank 12 for the same reason described above.

Each lower semi-diaphragm of the series of lower semi-diaphragms 16, is coupled with and can be constrained, by means of fixing means, to the respective upper semi-diaphragm of the series of the upper semidiaphgrams 18, to form a whole diaphragm 30, having a central pass-through hole in which the shaft 13 is inserted.

The fixing means preferably include screws 15 or tie-rods which can be inserted in suitable housings situated in the lower semi-diaphragms 16 and upper semi-diaphragms 18.

Furthermore, the lower semi-diaphragms 16 of each stage are packed and tightly constrained to one another by blocking means, and, at the same time, the upper semi-diaphragms 18 of each stage are also packed and tightly restrained to one another by blocking means.

The blocking means include screws, tie-rods and pins.

A first pile 41 of lower semi-diaphragms 16 and a second pile 42 of upper semi-diaphragms 18 are thus obtained for each stage 10 of the multistage centrifugal compressor.

It is also evident that, as a whole, the multistage centrifugal compressor has a set of first piles 41 of lower semi-diaphragms 16 and a set of second piles 42 of upper semi-diaphragms 18.

The correct positioning and centering during the assembly of the multistage centrifugal compressor is therefore highly facilitated, as each first pile 41 and each second pile 42 can be easily moved and positioned, due to the fact that the semi-diaphragms are tightly constrained to one another and consequently there is no possibility of relative movement among them.

In particular, each second pile 42 can be positioned on the corresponding first pile 41, regardless of the upper semi-tank of the compressor.

Each first pile 41 of lower semi-diaphragms 16, is constrained to the corresponding lower half-ring 21 and, in the same way, each second pile 42 of upper semi-diaphragms 18, is constrained to the corresponding upper half-ring 22.

This is to balance the axial forces acting on the series of diaphragms during the functioning of the multistage centrifugal compressor and to center them with respect to the tank.

The diaphragms can therefore transmit, through the blocking means, the stress received during the functioning of the multistage centrifugal compressor, to the supporting ring, and subsequently to the lower semi-tank 11 and upper semi-tank 12 of the multistage centrifugal compressor, at the same time maintaining the seal between the various stages.

Furthermore, for the assembly of the multistage centrifugal compressor, it is possible to assemble the empty upper semi-tank, with a considerable advantage both for the equipment, lifting and moving cost as well as from a safety point of view for the whole operation.

According to another aspect of the present invention, a procedure is provided, for the assembly of a multistage centrifugal compressor, comprising the stages of (a) forming a series of first piles of lower semi-trifugal diaphragms 16, and a series of second piles 42 of upper semi-diaphragms 18, (b) assembling a first pile 41 of lower semi-diaphragms 16, in the lower semi-tank 11, in each stage, by constraining a lower semi-diaphragms 16 of each first pile 41 to the lower half-ring 21, (c) assembling the shaft 13 equipped with the series of rotors 14 on the series of first piles 41 of lower semi-diaphragms 16, (d) coupling and constraining the series of second piles 42 with the series of first piles 41, (e) assembling the upper semi-tank 12 on the lower semi-tank 11, constraining an upper semi-diaphragm 18 of each second pile 42 to the corresponding upper half-ring 22 and (f) closing the multistage centrifugal compressor.

In stage (a) each first pile 41 of lower semi-diaphragms 16 and each second pile 42 of upper semi-diaphragms 18, is obtained by constraining the lower semi-diaphragms 16 of each stage to each other and, in the same way, by constraining the upper semi-diaphragms 18 to each other.

Stage (a) is preferably effected by constraining the lower semi-diaphragms 16 to each other, by means of axial screws 17, and by constraining the upper semi-diaphragms 18 to each other, by means of axial screws 19.

Stage (d) is preferably effected by constraining each first pile 41 to the corresponding second pile 42 by means of screws 15.

With reference to FIGS. 2*a*-2*d*, a preferred way of forming a first pile 41 of lower semi-diaphragms 16 of each stage and a second pile 42 of upper semi-diaphragms 18 of each stage, is to position a lower semi-diaphragm 16 on a flat surface, coupling it and constraining it to a corresponding upper semi-diaphragm 18, to form a complete diaphragm 30.

A further lower semi-diaphragm 16 is subsequently positioned on the first lower semi-diaphragm 16 of the newly formed diaphragm 30, and is respectively coupled and constrained to a further upper semi-diaphragm 18, arranging it above the first upper semi-diaphragm 18.

These operations are repeated several times in order to couple all the semi-diaphragms of a stage of the multistage centrifugal compressor, thus forming all the complete diaphragms, piled up one above the other.

All the lower semi-diaphragms 16 of one stage are then axially constrained by means of axial screws 17 and, in the same way, all the upper semi-diaphragms 18 of the same stage are then axially constrained by means of axial screws 19.

The constraints which join the upper semi-diaphragms 18 of one stage to the corresponding lower semi-diaphragms 16 of the same stage are removed, thus obtaining a first pile 41 of lower semi-diaphragms 16, stacked one on top of another, and a second pile 42 of upper semi-diaphragms 18 stacked one on top of another.

It can therefore be seen that a multistage centrifugal compressor having a tank which can be opened horizontally according to the present invention, achieves the objectives listed above.

The multistage centrifugal compressor having a tank which can be opened horizontally of the present invention, thus conceived, can be subjected to numerous modifications and variations, all forming part of the same inventive concept.

Furthermore, in practice, the materials used, as also their dimensions and components, can vary according to technical demands.

The invention claimed is:

1. Multistage centrifugal compressor having a tank which can be opened horizontally, comprising a lower semi-tank and an upper semi-tank, a shaft having a series of rotors and a series of stages each of which comprising, in turn, a series of lower semi-diaphragms and a series of upper semi-diaphragms, a lower half-ring and an upper half-ring which can be coupled to form a bearing ring, said lower half-ring being fixed internally to the lower semi-tank, and said corresponding upper half-ring being fixed to the upper semi-tank, wherein in each stage of the multistage centrifugal compressor, the lower semi-diaphragms are tightly constrained to one another by blocking means, to form a first pile of lower semi-diaphragms and, the corresponding upper semi-diaphragms are tightly constrained to one another by blocking means, to form a second pile of lower semi-diaphragms, and in that said first pile can be constrained to said lower half-ring and said second pile can be constrained to said upper half-ring.

2. The multistage centrifugal compressor having a tank which can be opened horizontally according to claim 1, wherein said blocking means include first axial screws and second axial screws to constrain the lower semi-diaphragms (16) and the upper semi-diaphragms (18), respectively.

3. A procedure for the assembly of a multistage centrifugal compressor having a tank which can be opened horizontally according to claim 1, further comprising following stages: (a) forming a series of first piles of lower semi-diaphragms, and a series of second piles upper semi-diaphragms, (b) assembling the series of first piles of lower semi-diaphragms in the lower tank, by constraining a lower semi-diaphragm of each first pile to the lower half-ring of the corresponding stage, (c) assembling the shaft equipped with the series of rotors on the series of first piles of lower semi-diaphragms, (d) coupling and constraining the series of second piles with the series of first piles, (e) assembling the upper semi-tank on the lower semi-tank, constraining an upper semi-diaphragm of each second pile to the upper half-ring of the corresponding stage and (f) closing the multistage centrifugal compressor.

4. A procedure for the assembly of a multistage centrifugal compressor having a tank which can be opened horizontally according to claim 3, wherein in stage (a) the first pile of lower semi-diaphragms is obtained by constraining the lower semi-diaphragms to one another, whereas the second pile of upper semi-diaphragms is obtained by constraining the upper semi-diaphragms to one another.

5. A procedure for the assembly of a multistage centrifugal compressor having a tank which can be opened horizontally according to claim 4, wherein stage (a) is effected by constraining the lower semi-diaphragms to one another by means of first axial screws and by constraining the upper semi-diaphragms to one another by means of second axial screws.

6. A procedure for the assembly of a multistage centrifugal compressor having a tank which can be opened horizontally according to claim 3, wherein stage (d) is effected by constraining the first pile to the second pile by means of screws.

* * * * *